US007125225B2

(12) United States Patent
Surace et al.

(10) Patent No.: US 7,125,225 B2
(45) Date of Patent: Oct. 24, 2006

(54) COOLED ROTOR BLADE WITH VIBRATION DAMPING DEVICE

(75) Inventors: Raymond C. Surace, Middletown, CT (US); Edwin Otero, Southington, CT (US); Shawn J. Gregg, Wethersfield, CT (US); Tracy A. Propheter, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 82 days.

(21) Appl. No.: 10/771,587

(22) Filed: Feb. 4, 2004

(65) Prior Publication Data

US 2005/0169754 A1 Aug. 4, 2005

(51) Int. Cl.
*F01D 5/16* (2006.01)

(52) U.S. Cl. ..... 416/96 R; 416/96 A; 416/224; 416/500

(58) Field of Classification Search ..... 415/119; 416/96 R, 96 A, 244, 500, 224
See application file for complete search history.

(56) References Cited

U.S. PATENT DOCUMENTS 3,610,778 A * 10/1971 Suter ..... 416/210 R
5,156,528 A * 10/1992 Bobo ..... 416/190
5,558,497 A 9/1996 Kraft et al. ..... 416/96
5,820,343 A 10/1998 Kraft et al. ..... 416/96

* cited by examiner

*Primary Examiner*—Ninh H. Nguyen

(57) ABSTRACT

A rotor blade for a rotor assembly is provided that includes a root, an airfoil, and a damper. The airfoil has a length, a base, a tip, a first side wall, a second side wall, and at least one cavity. The length extends the base and the tip. The at least one cavity is disposed between the side walls, and the channel is defined by a first wall portion and a second wall portion. The damper, which is selectively received within the channel, includes a first bearing surface, a second bearing surface, a forward surface, and an aft surface, all of which extend lengthwise. At least one of the surfaces is shaped to form a lengthwise extending passage within the channel. The passage has a flow direction oriented along the length of the at least one surface to permit cooling air travel along the at least one surface in a lengthwise direction. According to one aspect of the present invention, the damper has an arcuate lengthwise extending centerline.

19 Claims, 4 Drawing Sheets

COOLED ROTOR BLADE WITH VIBRATION DAMPING DEVICE

The invention was made under a U.S. Government contract and the Government has rights herein.

BACKGROUND OF THE INVENTION

1. Technical Field

This invention applies to rotor blades in general, and to apparatus for damping vibration within and cooling of a rotor blade in particular.

2. Background Information

Turbine and compressor sections within an axial flow turbine engine generally include a rotor assembly comprising a rotating disc and a plurality of rotor blades circumferentially disposed around the disk. Each rotor blade includes a root, an airfoil, and a platform positioned in the transition area between the root and the airfoil. The roots of the blades are received in complementary shaped recesses within the disk. The platforms of the blades extend laterally outward and collectively form a flow path for fluid passing through the rotor stage. The forward edge of each blade is generally referred to as the leading edge and the aft edge as the trailing edge. Forward is defined as being upstream of aft in the gas flow through the engine.

During operation, blades may be excited into vibration by a number of different forcing functions. Variations in gas temperature, pressure, and/or density, for example, can excite vibrations throughout the rotor assembly, especially within the blade airfoils. Gas exiting upstream turbine and/or compressor sections in a periodic, or "pulsating", manner can also excite undesirable vibrations. Left unchecked, vibration can cause blades to fatigue prematurely and consequently decrease the life cycle of the blades.

It is known that friction between a damper and a blade may be used as a means to damp vibrational motion of a blade.

One known method for producing the aforesaid desired frictional damping is to insert a long narrow damper (sometimes referred to as a "stick" damper) within a turbine blade. During operation, the damper is loaded against an internal contact surface within the turbine blade to dissipate vibrational energy. One of the problems with stick dampers is that they create a cooling airflow impediment within the turbine blade. A person of skill in the art will recognize the importance of proper cooling air distribution within a turbine blade. To mitigate the blockage caused by the stick damper, some stick dampers include widthwise (i.e., substantially axially) extending passages disposed within their contact surfaces to permit the passage of cooling air between the damper and the contact surface of the blade. Although these passages do mitigate the blockage caused by the damper, they only permit localized cooling at discrete positions. The contact areas between the passages remain uncooled, and therefore have a decreased capacity to withstand thermal degradation. Another problem with machining or otherwise creating passages within a stick damper is that the passages create undesirable stress concentrations that decrease the stick damper's low cycle fatigue capability.

In short, what is needed is a rotor blade having a vibration damping device that is effective in damping vibrations within the blade and that enables effective cooling of itself and the surrounding area within the blade.

DISCLOSURE OF THE INVENTION

It is, therefore, an object of the present invention to provide a rotor blade for a rotor assembly that includes means for effectively damping vibration within that blade.

It is still another object of the present invention to provide means for damping vibration that enables effective cooling of itself and the surrounding area within the blade According to the present invention, a rotor blade for a rotor assembly is provided that includes a root, an airfoil, and a damper. The airfoil has a length, a base, a tip, a first side wall, a second side wall, and at least one cavity. The length extends the base and the tip. The at least one cavity is disposed between the side walls, and the channel is defined by a first wall portion and a second wall portion. The damper, which is selectively received within the channel, includes a first bearing surface, a second bearing surface, a forward surface, and an aft surface, all of which extend lengthwise. At least one of the surfaces is shaped to form a lengthwise extending passage within the channel. The passage has a flow direction oriented along the length of the at least one surface to permit cooling air travel along the at least one surface in a lengthwise direction.

An advantage of the present invention is that a more uniform dispersion of cooling air is enabled between the damper and the airfoil wall than is possible with the prior art of which we are aware. The more uniform dispersion of cooling air decreases the chance that thermal degradation will occur in the damper or the area of the airfoil proximate the damper.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
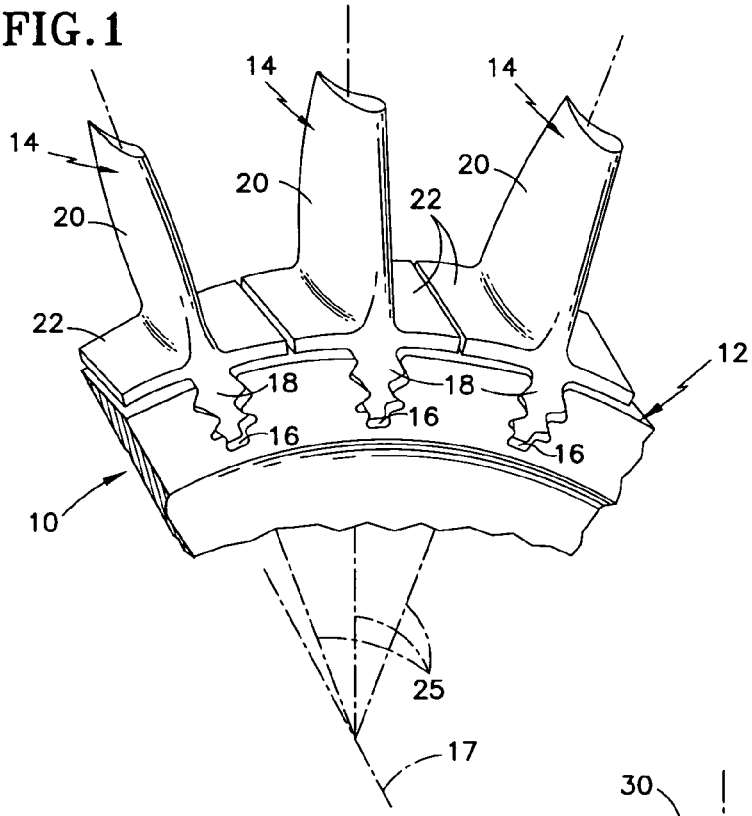
FIG. 1 is a partial perspective view of a rotor assembly.
Figure 2:
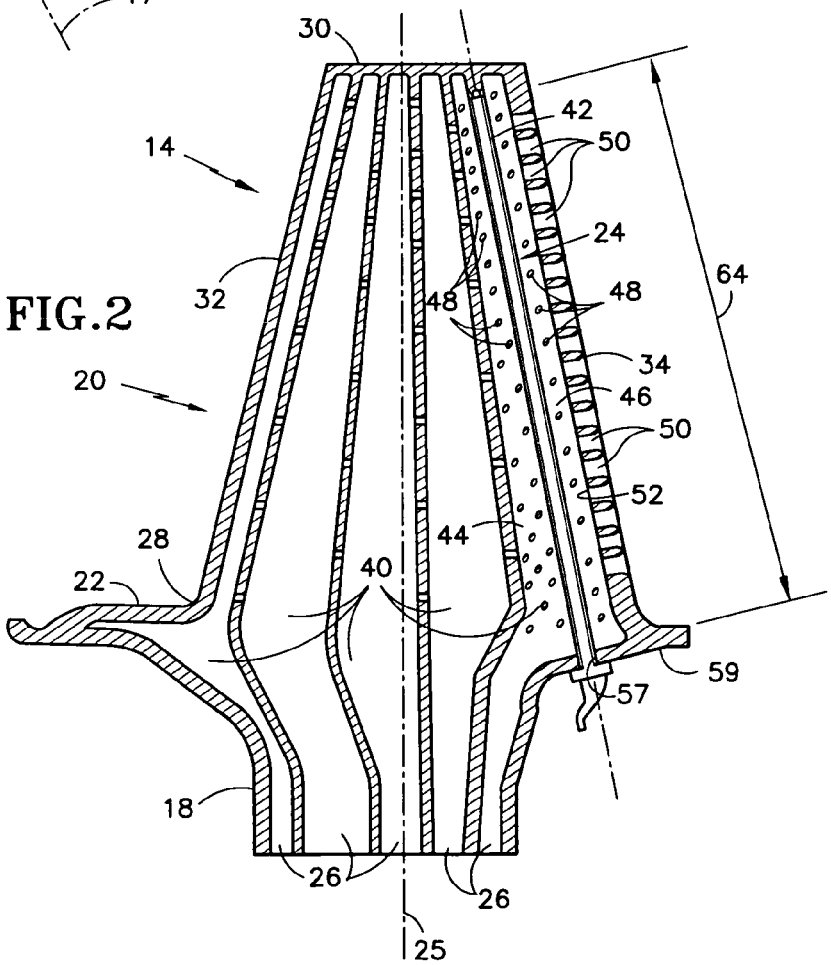
FIG. 2 is a diagrammatic sectioned rotor blade.

Referring to FIG. 1, a rotor blade assembly 10 for a gas turbine engine is provided having a disk 12 and a plurality of rotor blades 14. The disk 12 includes a plurality of recesses 16 circumferentially disposed around the disk 12 and a rotational centerline 17 about which the disk 12 may rotate. Each blade 14 includes a root 18, an airfoil 20, a platform 22, and a damper 24 (see FIG. 2). Each blade 14 also includes a radial centerline 25 passing through the blade 14, perpendicular to the rotational centerline 17 of the disk 12. The root 18 includes a geometry that mates with that of one of the recesses 16 within the disk 12. A fir tree configuration is commonly known and may be used in this instance. As can be seen in FIG. 2, the root 18 further includes conduits 26 through which cooling air may enter the root 18 and pass through into the airfoil 20.

Figure 3:
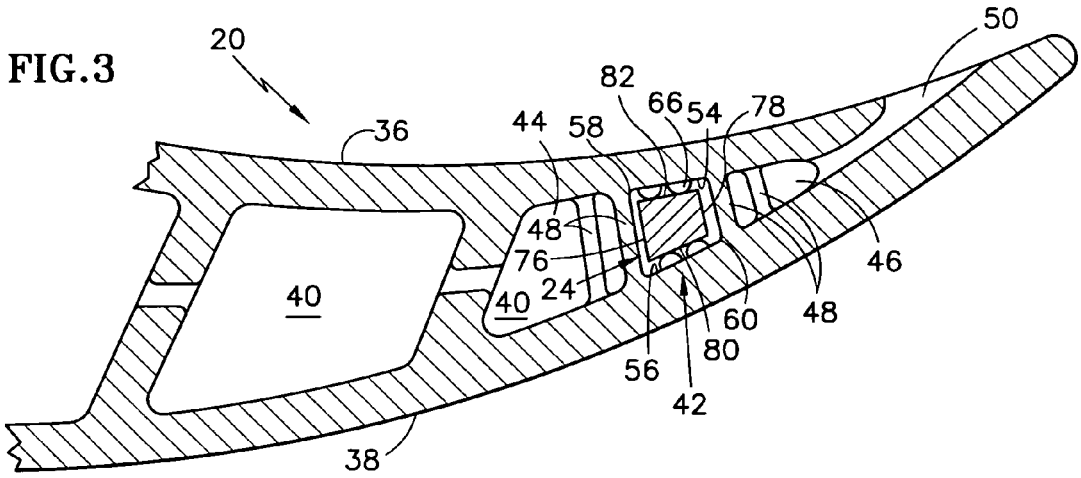
FIG. 3 is a diagrammatic section of a rotor blade portion.
Figure 4:
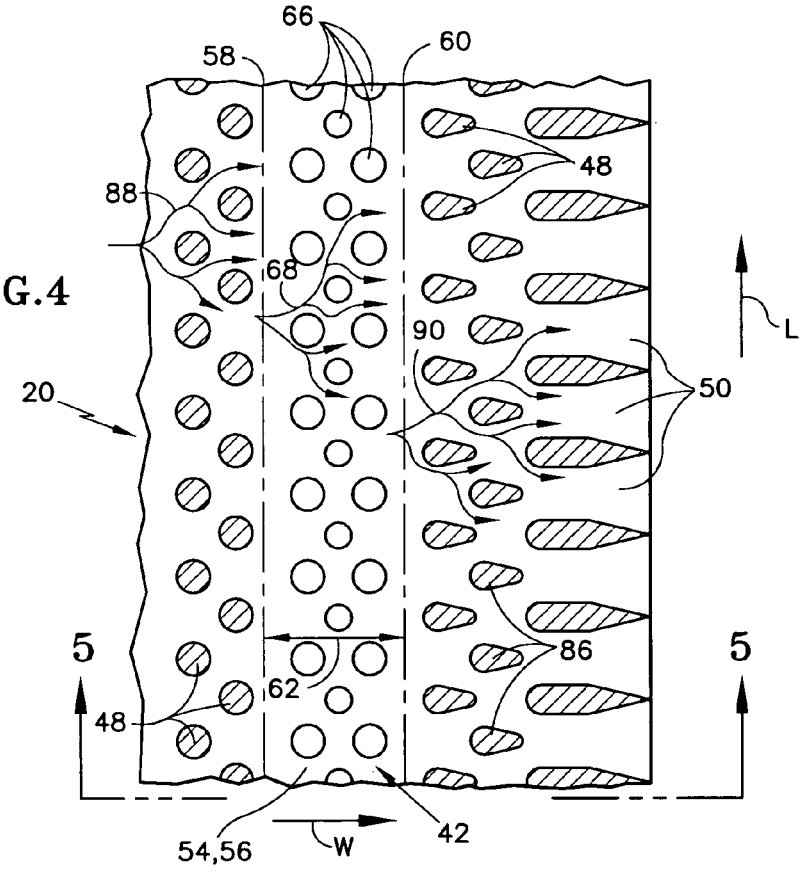
FIG. 4 is a diagrammatic view of a portion of the first and second cavity portions and channel disposed therebetween, illustrating a first embodiment of raised features.
Figure 5:
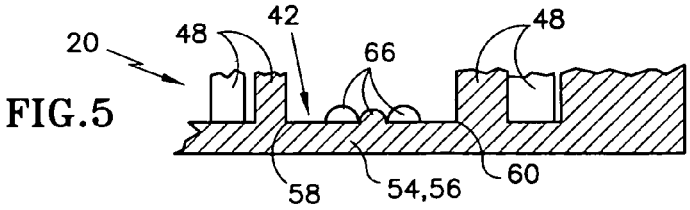
FIG. 5 is an end view of the view shown in FIG. 4.
Figure 6:
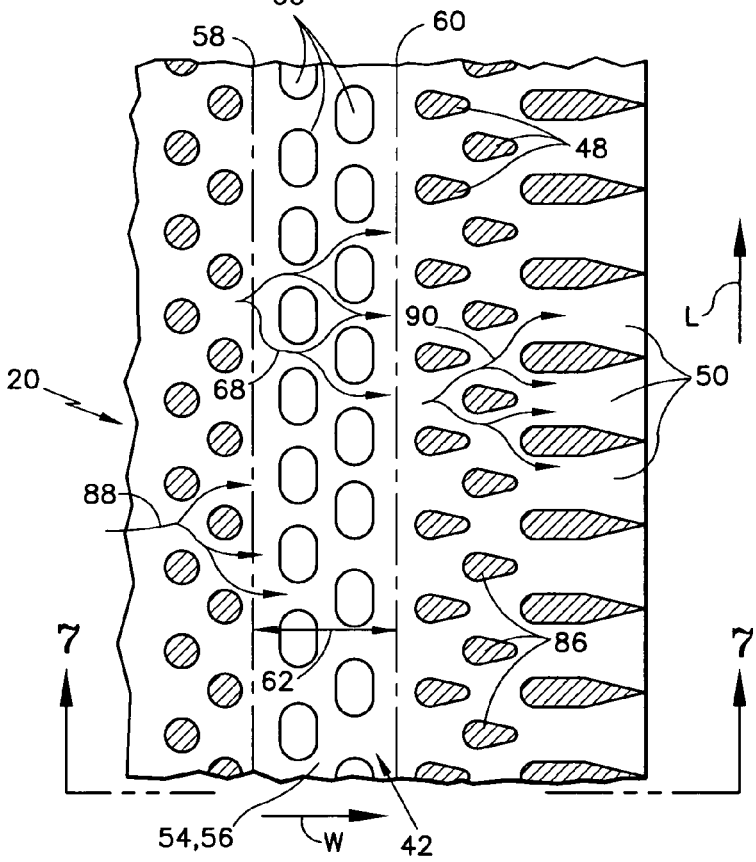
FIG. 6 is a diagrammatic view of a portion of the first and second cavity portions and channel disposed therebetween, illustrating a second embodiment of raised features.
Figure 7:
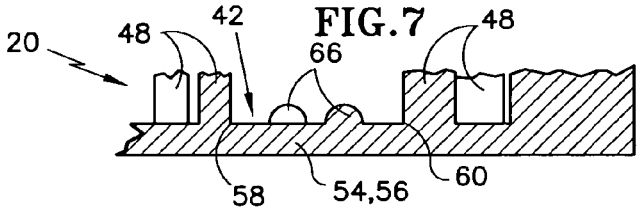
FIG. 7 is an end view of the view shown in FIG. 6.

Referring to FIGS. 1–3, the airfoil 20 includes a base 28, a tip 30, a leading edge 32, a trailing edge 34, a pressure side wall 36, a suction side wall 38, a cavity 40 disposed therebetween, and a channel 42. FIG. 2 diagrammatically illustrates an airfoil 20 sectioned between the leading edge 32 and the trailing edge 34. The pressure side wall 36 and the suction side wall 38 extend between the base 28 and the tip 30 and meet at the leading edge 32 and the trailing edge 34. The cavity 40 can be described as having a first cavity portion 44 forward of the channel 42 and a second cavity portion 46 aft of the channel 42. In an embodiment where an airfoil 20 includes a single cavity 40, the channel 42 is disposed between portions of the one cavity 40. In an embodiment where an airfoil 20 includes more than one cavity 40, the channel 42 may be disposed between adjacent cavities. To facilitate the description herein, the channel 42 will be described herein as being disposed between a first cavity portion 44 and a second cavity portion 46, but is intended to include multiple cavity and single cavity airfoils 20 unless otherwise noted. In the embodiment shown in FIGS. 2–7, the second cavity portion 46 is proximate the trailing edge 34, and both the first cavity portion 44 and the second cavity portion 46 include a plurality of pedestals 48 extending between the walls of the airfoil 20. The characteristics of a preferred pedestal arrangement are disclosed below. In alternative embodiments, only one or neither of the cavity portions contain pedestals 48, and the channel 42 is defined forward and aft by ribs 49 with cooling apertures disposed therein (see FIG. 13). A plurality of ports 50 are disposed along the aft edge 52 of the second cavity portion 46, providing passages for cooling air to exit the airfoil 20 along the trailing edge 34. Although the channel is described as being proximate the trailing edge, it may be positioned elsewhere within the airfoil (e.g., proximate the leading edge) and is not, therefore, limited to being proximate the trailing edge.

The channel 42 between the first and second cavity portions 44,46 is defined laterally by a first wall portion 54 and a second wall portion 56 that extend lengthwise between the base 28 and the tip 30, substantially the entire distance between the base 28 and the tip 30. The channel 42 is defined forward by a plurality of pedestals 48 or a rib 49 (see FIG. 13), or some combination thereof, disposed along a first lengthwise edge 58. The channel 42 is defined aft by a plurality of pedestals 48 or a rib 49 (see FIG. 13), or some combination thereof, disposed along a second lengthwise edge 60. One or both wall portions 54,56 include a plurality of raised features 66 that extend outwardly from the wall into the channel 42. As will be explained below, the raised features 66 may have a geometry that enables them to form a point, line, or area contact with the damper 24, or some combination thereof. Examples of the shapes that a raised feature 66 may assume include, but are not limited to, spherical, cylindrical, conical, or truncated versions thereof, of hybrids thereof. The distance that the raised features 66 extend outwardly into the channel 42 may be uniform or may purposefully vary between raised features 66.

From a thermal perspective, a point contact is distinguished from an area contact by virtue of the point contact being a small enough area that heat transfer from cooling air passing the point contact cools the point contact to the extent that the temperature of the damper 24 and the airfoil wall portion 54,56 at the point contact are not appreciably different from that of the surrounding area. A line contact is distinguished similarly; e.g., a line contact is distinguished from an area contact by virtue of the line contact being a small enough area that heat transfer from cooling air passing the line contact cools the line contact to the extent that the temperature of the damper 24 and the airfoil wall portion 54,56 at the line contact is not appreciably different from that of the surrounding area.

From a damping perspective, a point contact is distinguished from an area contact by virtue of the magnitude of the load transmitted through the point contact versus through an area contact. Regardless of the size of the contact, the load for a given set of operating conditions will be the same and it will be distributed as a function of force per unit area. In the case of a plurality of point contacts, the load will be substantially higher per unit area than it would be for a much larger area contact relatively speaking. A line contact is distinguished similarly; e.g., a line contact is distinguished from an area contact by virtue of the line contact having a substantially higher load per unit area than it would be for a much larger area contact relatively speaking.

Referring to FIGS. 4–7, the size and the arrangement of the raised features 66 within the channel 42 relative to the size of the channel 42 are such that tortuous flow passages 68 are created across the width of the channel 42. As a result, cooling air flow entering the channel 42 across the first lengthwise extending edge 58 encounters and passes a plurality of raised features 66 within the channel 42 prior to exiting the channel 42 across the second lengthwise extending edge 60. The directional components of the cooling air flow within the tortuous flow passages 68 are discussed below. The raised features 66 within the channel 42 may be arranged randomly and still form the aforesaid tortuous flow passages across the width of the channel 42. The raised features 66 may also be arranged into rows, wherein the raised features 66 within one row are offset from the raised features 66 of an adjacent row to create the aforesaid tortuous flow path 68 between the pedestals 48.

With respect to the directional components of the cooling air flow within the tortuous flow passages 68, substantially all of the tortuous flow passages 68 include at least one portion that extends at least partially in a lengthwise direction (shown as arrow "L") and at least one portion that extends at least partially in a widthwise direction (shown as arrow "W"). The tortuous flow passages 68 desirably facilitate heat transfer between the damper 24 and the cooling air, and between the airfoil wall portion 54,56 and the cooling air, for several reasons. A principle reason is that the convective heat transfer efficiency within that region is increased because of the type of flow created. The tortuous path creates turbulent flow which increases the heat transfer efficiency. The heat transfer is also increased because: 1) cooling air passing through the tortuous flow passages 68 has a longer dwell time between the damper 24 and the airfoil wall portion 54,56 than cooling air typically would in a widthwise extending slot; and 2) the surface area of the damper 24 and the airfoil 20 exposed to the cooling air within the tortuous flow passages 68 is increased relative to that typically exposed within a prior art damper arrangement having widthwise extending slots. These cooling advantages are not available to a damper having only widthwise extending slots and area contacts therebetween.

Figure 8:
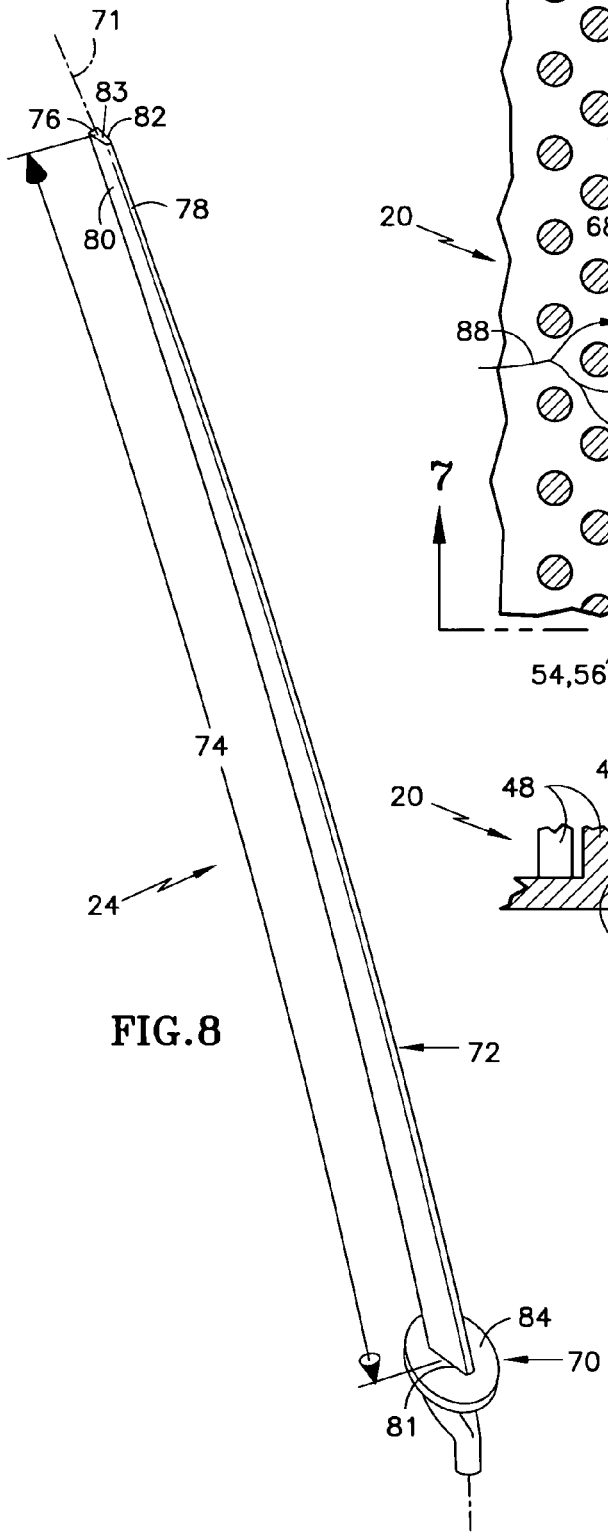
FIG. 8 is a perspective view of a damper embodiment.
Figure 9:
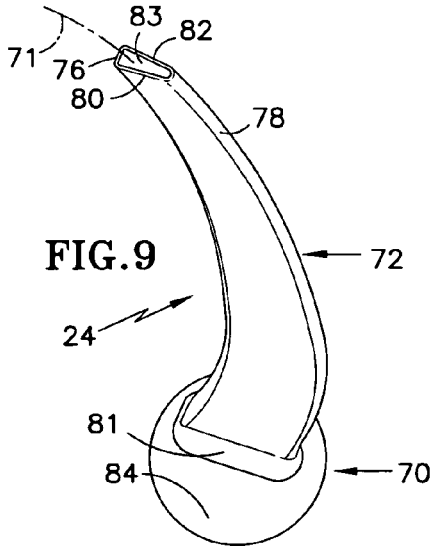
FIG. 9 is a perspective view of a damper embodiment.

Referring to FIGS. 8 and 9, the damper 24 includes a base 70 and a body 72 and a lengthwise extending centerline 71. The body 72 includes a length 74, a forward face 76, an aft face 78, a first bearing surface 80, a second bearing surface 82, a base end 81, and a tip end 83. The base 70 may contain a seal surface 84 for sealing between the base 70 and the blade 14. The body centerline 71 may extend along a straight line, an arcuate line, or some combination thereof.

In a preferred embodiment illustrated in FIG. 9, the damper body 72 has an arcuate lengthwise extending centerline 71 that gives the body 72 a variable lean angle when mounted within the airfoil 20. The geometry of the arcuate centerline 71, and the lean angle it produces, can be varied to suit the application. In some embodiments, the curvature of the arcuate centerline 71 increases when traveling lengthwise from the head end 81 of the damper 24 toward the tip end 83 of the damper 24. For purposes of this disclosure "an increase in the curvature of the arcuate centerline" is used to indicate an increase in the difference between the slope of the damper body 72 and the slope of the blade's radial centerline 25. As a consequence of the variable lean angle of the damper 24 created by the arcuate centerline 71, the center of gravity of the damper 24 produces a restoring moment when the damper 24 is subject to centrifugal loading. The restoring moment, in turn, produces a desirable normal load between the bearing surfaces 80,82 and the wall portions 54,56. The increased lean angle proximate the tip end 83 of the damper 24, creates greater normal loading proximate the tip end 83 than would be possible with a straight damper.

Figure 12:
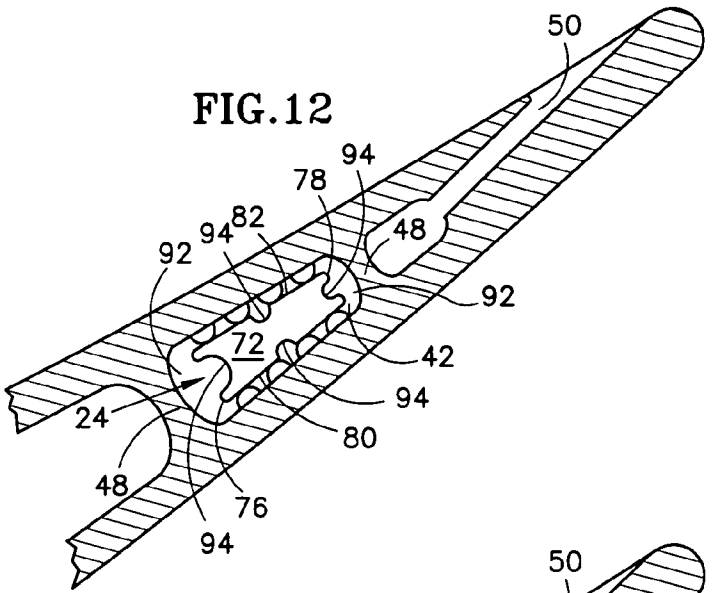
FIGS. 10–13 are diagrammatic sectioned views of an airfoil, each with a different damper embodiment disposed within the airfoil channel.
Figure 13:
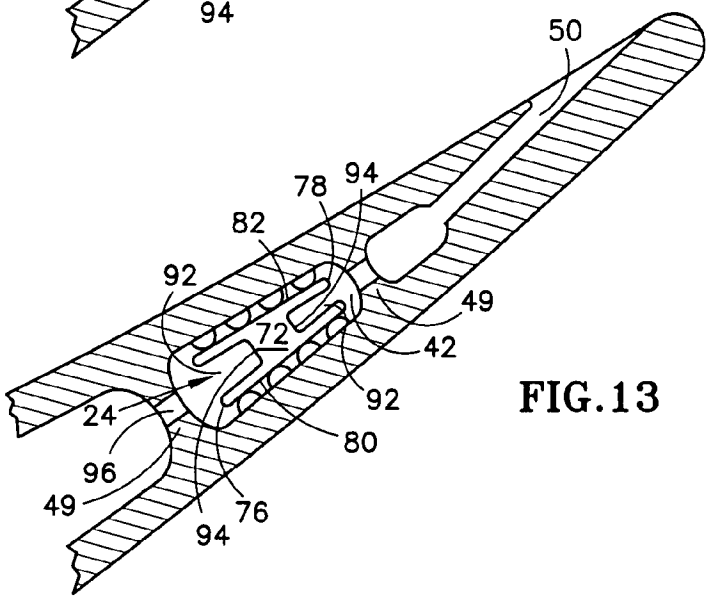
Figure 10:
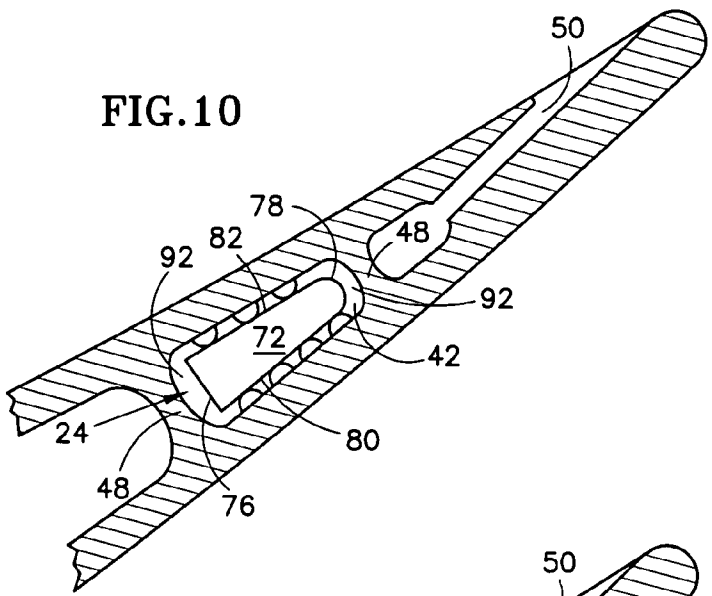
Figure 11:
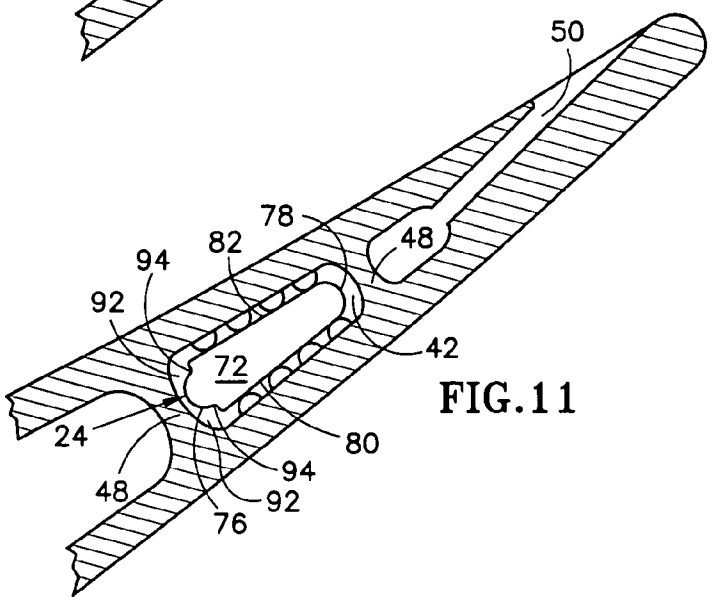

Referring to FIGS. 10–13, the damper body 72 is shaped in cross-section to mate with the cross-sectional shape of the channel 42; i.e., the general cross-sectional shape of the damper 24 mates with cross-sectional shape of the channel 42. In those instances where the channel 42 includes raised features 66, the raised features 66 may define the cross-sectional profile of the channel 42. The specific cross-sectional shape of the damper 24 can, however, assume a variety of different cross-sectional shapes to create one or more lengthwise extending passages 92 within the channel 42. The passage 92 has a flow direction that is oriented along the length of the surface to which it is adjacent, to permit cooling air travel along that surface in a lengthwise direction. In FIG. 10 for example, the forward face 76 of the damper 24 is planar. When the damper 24 is received within the channel 42, a passage 92 is created between the pedestals 48 (or rib 49) and the forward face 76 within which cooling air can travel along the forward face 76 in a lengthwise direction. The embodiment shown in FIG. 10 also includes an aft face 78 shaped to mate with the adjacent portion of the channel 42 such that smooth flow passages are formed therebetween. In the embodiments shown in FIGS. 11–13, the damper 24 includes one or more lengthwise extending grooves 94 disposed in the forward face 76, aft face 78, first bearing surface 80, and/or second bearing surface 82. An advantage of utilizing a groove 94 is that the groove 94 can be located relative to a face in a position where it can provide optimal cooling, while still permitting the requisite damping. The one or more grooves 94 extend a length along the damper 24 sufficient to create flow in a lengthwise direction that is non-random. In FIG. 11, for example, the damper 24 includes a pair of grooves 94, each disposed at the corner between the forward face 76 and a bearing surface 80,82. In FIG. 12, the damper 24 includes a groove 94 disposed in the forward face 76, aft face 78, first bearing surface 80, and the second bearing surface 82. In FIG. 13, the damper 24 has an "H" shape wherein grooves are disposed in the forward and aft faces 76,78. The present invention damper 24 is not limited to these embodiments, but can include any damper that creates a lengthwise extending passage 92 within the channel, having a flow direction oriented along the length of the surface to which it is adjacent.

Referring to FIGS. 2–7, in preferred embodiments the first cavity portion 44 and the second cavity portion 46 include a plurality of pedestals 48 extending between the walls of the airfoil 20, proximate the channel 42. The pedestals 48, located within the first cavity portion 44 adjacent the first lengthwise extending edge of the channel 42, are shown in FIGS. 2–5 as substantially cylindrical in shape. Other pedestal 48 shapes may be used alternatively. The plurality of pedestals 48 within the first cavity portion 44 are preferably arranged in an array having a plurality of rows offset from one another to create a tortuous flow path 88 between the pedestals 48. The tortuous flow path 88 improves local heat transfer and promotes uniform flow distribution for the cooling air entering the channel 42 across the first lengthwise extending edge 58. The pedestal array can be disposed along a portion or all of the length of the cavity 44.

The pedestals 48 within the second cavity portion 46 may assume a variety of different shapes; e.g., cylindrical, oval, etc., and are located adjacent the second lengthwise extending edge 60 of the channel 42. In the embodiments shown in FIGS. 4–7, each pedestal 48 includes a convergent portion 86 that extends out in an aftward direction; e.g., a teardrop shaped pedestal 48 with the convergent portion 86 of the teardrop oriented toward the trailing edge 34. Cooling air flow traveling in the direction forward to aft past the aft-positioned convergent portion 86 forms a smaller wake than would similar flow traveling past, for example, a circular shaped pedestal 48. The decreased wakes provide desirable flow characteristics entering the trailing edge ports 50. The plurality of pedestals 48 within the second cavity portion 46 are preferably arranged in an array having a plurality of rows offset from one another to create a tortuous flow path 90 between the pedestals 48. The tortuous flow path 90 improves local heat transfer and promotes uniform flow distribution for the cooling air exiting the channel 42 across the second lengthwise extending edge 60. The pedestal array can be disposed along a portion or all of the length of the cavity 46. The aft-most row is located so that the pedestals 48 contained therein are aligned relative to the cooling features of the trailing edge 34. For example, the pedestals 48 within the aft-most row shown in FIGS. 4–7 are aligned with the ports 50 disposed along the trailing edge 34. As indicated above, the position of the channel 42 is not limited to being proximate the trailing edge 34.

In the embodiment shown in FIG. 13, the channel 42 is defined forward and aft by ribs 49 with cooling apertures 96 disposed therein.

Referring to FIGS. 1–9, under steady-state operating conditions, a rotor blade assembly 10 within a gas turbine engine rotates through core gas flow passing through the engine. The high temperature core gas flow impinges on the blades 14 of the rotor blade assembly 10 and transfers a considerable amount of thermal energy to each blade 14, usually in a non-uniform manner. To dissipate some of the thermal energy, cooling air is passed into the conduits 26 within the root 18 of each blade. From there, a portion of the cooling air passes into the first cavity portion 44 where pressure differences direct it toward and into the array of pedestals 48 adjacent the first lengthwise extending edge 58 of the channel 42. From there the cooling air crosses the first lengthwise extending edge 58 of the channel 42 and a portion enters the tortuous flow passages 68 formed between the airfoil wall portion 54,56, the damper 24, and the raised features 66 extending therebetween. Another portion enters the one or more lengthwise extending passages 92 disposed between one or more of the forward face 76, aft face 78, bearing surfaces 80,82, and the pedestals 48 (or rib 49) and airfoil wall portions 54,56. Cooling air traveling within one of the lengthwise extending passages 92 may travel all or a portion of the damper length 24 and exit into one of the tortuous flow passages 68. Substantially all of the tortuous flow passages 68 include at least a portion that extends at least partially in a lengthwise direction and at least a portion that extends at least partially in a widthwise direction. As a result, cooling air within the tortuous flow passages 68 distributes lengthwise as it travels across the width of the damper 24. Once the cooling air has traveled across the width of the damper 24, it exits the passages 68, crosses the second lengthwise extending edge 60 of the channel 42, and enters the array of pedestals 48 adjacent the second lengthwise extending edge 60 of the channel 42. Once the flow passes through the array of pedestals 48 adjacent the second lengthwise extending edge 60 of the channel 42, it exits the ports 50 disposed along the trailing edge 34 of the airfoil 20.

The bearing surfaces 80,82 of the damper 24 contact the raised features 66 extending out from the wall portions 54,56 of the channel 42. Depending upon the internal characteristics of the airfoil 20, the damper 24 may be forced into contact with the raised features 66 by a pressure difference across the channel 42. A contact force is further effectuated by centrifugal forces acting on the damper 24, created as the disk 12 of the rotor blade assembly 10 is rotated about its rotational centerline 17. The skew of the channel 42 relative to the radial centerline of the blade 25, and the damper 24 received within the channel 42, causes a component of the centrifugal force acting on the damper 24 to act in the direction of the wall portions 54,56 of the channel 42; i.e., the centrifugal force component acts as a normal force against the damper 24 in the direction of the wall portions 54,56 of the channel 42.

Although this invention has been shown and described with respect to the detailed embodiments thereof, it will be understood by those skilled in the art that various changes in form and detail thereof may be made without departing from the spirit and the scope of the invention. For example, the present invention is described above in terms of a damper 24 located proximate a trailing edge 34. As indicated above, the damper 24, channel 42, and pedestal 48 arrangements may be located elsewhere within the airfoil; e.g., proximate the leading edge 32.

What is claimed is:

1. A rotor blade for a rotor assembly, comprising:

a root;

an airfoil, having a length that extends between a base and a tip, a first side wall, a second side wall, at least one cavity disposed between the side walls, and a channel defined by a first wall portion and a second wall portion; and a damper selectively received within the channel, the damper including a body having a first bearing surface, a second bearing surface, a forward surface, and an aft surface, all of which extend lengthwise, wherein at least one of the surfaces is shaped to form a lengthwise extending passage within the channel, and wherein the passage has a flow direction that is oriented along the length of the at least one surface to permit cooling air travel along the at least one surface in a lengthwise direction.

2. The rotor blade of claim 1, wherein the at least one surface is shaped to include at least one groove, and that groove forms the lengthwise extending passage within the channel.

3. The rotor blade of claim 2, wherein the damper body includes a first lengthwise end and a second lengthwise end, and the at least one groove extends substantially between the lengthwise ends of the body.

4. The rotor blade of claim 2, wherein the damper body surfaces are shaped to include a plurality of lengthwise extending grooves.

5. The rotor blade of claim 4, wherein one or botb of the first bearing surface and second bearing surface are shaped to include a lengthwise extending groove.

6. The rotor blade of claim 1, wherein one or both of the first bearing surface and second bearing surface are shaped to include a lengthwise extending groove, and each groove forms the lengthwise extending passage within the channel.

7. The rotor blade of claim 6, wherein the damper body includes a first lengthwise end and a second lengthwise end, and the at least one groove extends substantially between the lengthwise ends of the body.

8. The rotor blade of claim 1, wherein the damper body includes a first lengthwise end, a second lengthwise end, and an arcuate lengthwise extending centerline.

9. The rotor blade of claim 8, wherein the arcuate centerline increases in curvature between lengthwise ends.

10. The rotor blade of claim 9, wherein the first lengthwise end of the damper body is disposed adjacent the base of the airfoil and the second lengthwise end of the damper body is disposed adjacent the tip of the airfoil, and the arcuate centerline increases in curvature in the direction from the first lengthwise end toward the second lengthwise end.

11. A rotor blade for a rotor assembly, comprising:

a root;

an airfoil, having a length that extends between a base and a tip, a first side wall, a second side wall, at least one cavity disposed between the side walls, and a channel defined by a first wall portion and a second wall portion; and a damper selectively received within the channel, the damper including a body having a first bearing surface, a second bearing surface, a forward surface, and an aft surface, all of which extend lengthwise, a first lengthwise end, a second lengthwise end, and an arcuate lengthwise extending centerline.

12. The rotor blade of claim 11, wherein the arcuate centerline increases in curvature between lengthwise ends.

13. The rotor blade of claim 12, wherein the first lengthwise end of the damper body is disposed adjacent the base of the airfoil and the second lengthwise end of the damper body is disposed adjacent the tip of the airfoil, and the arcuate centerline increases in curvature in the direction from the first lengthwise end toward the second lengthwise end.

14. A damper receivable within a channel in an internally cooled rotor blade, said damper comprising:

a first bearing surface;

a second bearing surface;

a forward surface; and an aft surface;

wherein at least one of the surfaces is shaped to include at least one lengthwise extending groove to accommodate a flow of coolant therewithin.

15. The rotor blade damper of claim 14, further comprising:

a first lengthwise end; and a second lengthwise end;

wherein the at least one lengthwise extending groove extends substantially between the lengthwise ends.

16. The rotor blade damper of claim 15, wherein the surfaces are shaped to include a plurality of lengthwise extending grooves.

17. The rotor blade of claim 14, wherein one or both of the first bearing surface and second bearing surface are shaped to include a lengthwise extending groove.

18. The rotor blade damper of claim 14, wherein the damper includes a first lengthwise end, a second lengthwise end, and an arcuate lengthwise extending centerline.

19. The rotor blade damper of claim 18, wherein the arcuate centerline increases in curvature between lengthwise ends.

* * * * *